US005160063A

United States Patent [19]

Bailey

[11] Patent Number: 5,160,063

[45] Date of Patent: Nov. 3, 1992

[54] REFUSE RECEPTACLE

[76] Inventor: Daryl K. Bailey, 398 Wilson Street, Saint John, New Brunswick, Canada, E2M 3T9

[21] Appl. No.: 637,812

[22] Filed: Jan. 7, 1991

[51] Int. Cl.[5] ..... B65D 25/14

[52] U.S. Cl. ..... 220/404; 220/908; 220/8; 297/193

[58] Field of Search ..... 297/193; 220/908, 909, 220/404, 403, 85 H, 506, 8, 410

[56] References Cited

U.S. PATENT DOCUMENTS

| | | | |
|---|---|---|---|
| 1,643,407 | 9/1927 | Florance | 220/908 |
| 2,912,702 | 11/1959 | Mackenzie | 297/193 |
| 3,052,371 | 9/1962 | Bemmelen | 220/404 |
| 3,338,458 | 8/1967 | Hultgren | 220/8 |
| 3,734,340 | 5/1973 | Ippolito et al. | 220/908 |
| 3,819,081 | 6/1974 | Runte | 220/8 |
| 4,444,355 | 4/1984 | Cary | 220/908 |
| 4,487,331 | 12/1984 | Hawker | 220/404 |
| 4,915,255 | 4/1990 | Curtis | 220/8 |
| 4,917,263 | 4/1990 | Korb | 220/908 |
| 4,978,021 | 12/1990 | Mini et al. | 220/8 |

FOREIGN PATENT DOCUMENTS

| | | | |
|---|---|---|---|
| 2132471 | 7/1984 | United Kingdom | 220/908 |

*Primary Examiner*—Stephen Marcus
*Assistant Examiner*—S. Castellano
*Attorney, Agent, or Firm*—Mirek A. Waraksa

[57] ABSTRACT

A receptacle holds a wide range of refuse bags in an open state and also functions as a footstool. The receptacle has an inner container that receives the bag. An upper part of the bag is folded over a resilient upper shoulder of the inner container. An outer container receives the inner container through an open bottom and has an upper opening to permit trash to be deposited into the bag. An internal portion of the outer container has an inclined camming surface and a vertical cylindrical surface that deflect and retain the shoulder to grip the bag thereby maintaining the bag in an open state. A cap fits over the opening of the outer container and provides a flat surface for standing. The cap and sidewall are structured to withstand an axial load of at least 300 pounds. A lower flange on the inner container seats against a horizontal floor surface and also seats the outer container contemporaneously with the gripping of the bag. The bag is properly retained while the receptacle is used as a footstool, and particularly on carpeted surfaces.

9 Claims, 2 Drawing Sheets

REFUSE RECEPTACLE

FIELD OF THE INVENTION

The invention relates generally to refuse receptacles, and more particularly, to receptacles capable of receiving a wide range of refuse bags.

BACKGROUND OF THE INVENTION

Plastic bags are made available to consumers from a variety of sources. Supermarkets commonly provide groceries in plastic bags with handles. Department and variety stores often provide sundry products in plain bags of many different sizes. Custom-sized bags are generally used in refuse receptacles, but it would be desirable to use the various bags given to consumers from various sources, as well as custom bags. Moreover, it would be advantageous if the trash receptacle could itself serve a second function.

It is consequently one object of the invention to provide a refuse receptacle capable of receiving a wide-range of bags and maintaining the bags in a proper open state for receipt of trash despite variations in the exact configuration of the bags.

Another object of the present invention in another aspect thereof to permit such a receptacle to function incidentally as a footstool.

SUMMARY OF THE INVENTION

In one aspect, the invention provides a refuse receptacle adapted to hold a refuse bag in an open state. The receptacle comprises an inner container with a closed bottom, a generally cylindrical sidewall including an upper circumferential sidewall portion, and a top with a central opening. The inner container receives the refuse bag. The receptacle also includes an outer container with an open bottom, a generally cylindrical sidewall, and a top with a central opening. The outer container is shaped to releasably receive the inner container through its open bottom such that the central openings are registered and refuse can be deposited in the bag. A generally annular internal structure attached to the outer container is shaped and positioned to engage a generally annular structure attached to the sidewall of the inner container, as the outer container receives the inner container, thereby to grip an upper portion of the bag that has been laid over the annular structure of the inner container and to maintain the bag in an open state. The annular nature of the gripping structures accommodates a wide range of bags, including bags formed with handles. A bag need only be located within the inner container with its top open and extended over the annular structure, even the handle-bearing portions of the bag. The outer container is then simply lowered over the inner container to engage the annular structures and grip the bag.

In preferred form, the annular structure of the inner container is sufficiently resilient as to deflect elastically from a first orientation downwardly to a second orientation in response to contact with the cooperating annular structure of the outer container to create bag gripping forces. The cooperating annular structure of the outer container preferably comprises a generally inclined camming surface that engages and deflects the annular structure of the inner container to its second position. A generally vertical cylindrical surface extends upwardly from the camming surface and is dimensioned to closely receive the annular structure in its defected second orientation from the camming surface. This arrangement causes not only a gradually deflection to avoid bag tearing, but also provides a positive indication when the bag is properly gripped. Resistance is felt as the annular structure of the inner container is deflected and a brief sliding action is sensed that indicates that the process is complete. The annular structure of the inner container may be internal or external, with the internal annular structure of the outer container appropriately configured, but external formation is preferred to simplify manufacture.

In another aspect, the receptacle is adapted to function as a footstool while avoiding potential tearing and attendant release of a bag. A cap is shaped to seat over the opening of the outer container and defines a generally horizontal upper surface, appropriate for standing. The cap and outer container are constructed to withstand vertical axial loads of at least 300 pounds, applied vertically to the upper surface of the cap, thereby accommodating the weight of most individuals with a margin of safety. The inner container comprises a circumferential structure extending radially outwardly from a bottom portion of the container and shaped to seat against a generally horizontal support surface, such as a floor. The upper surface of the circumferential structure is shaped to seat the bottom of the outer container. The containers are dimensioned to engage and grip the bag substantially contemporaneously with the seating of the outer container on the circumferential structure. Axial forces are reacted directly through the flange into the floor, and the seating of the outer container limits any significant displacement of the annular gripping structures relative to the bag thereby preventing potential tearing if someone steps abruptly onto the receptacle. This is particularly significant on carpeted surfaces where the outer container might potentially descend relative to the inner container. Additionally, the top of the upper container may be shaped and positioned to seat on the top of the inner container when the bottom of the outer container seats on the circumferential structure so that the two containers cooperate to withstand axial loads. This reduces structural demands placed on the outer container.

Other aspects of the invention will become apparent from a description of a preferred embodiment below and will be more specifically defined in the appended claims.

DESCRIPTION OF THE DRAWINGS

The invention will be better understood with reference to drawings in which.

DESCRIPTION OF PREFERRED EMBODIMENTS

Figure 1:
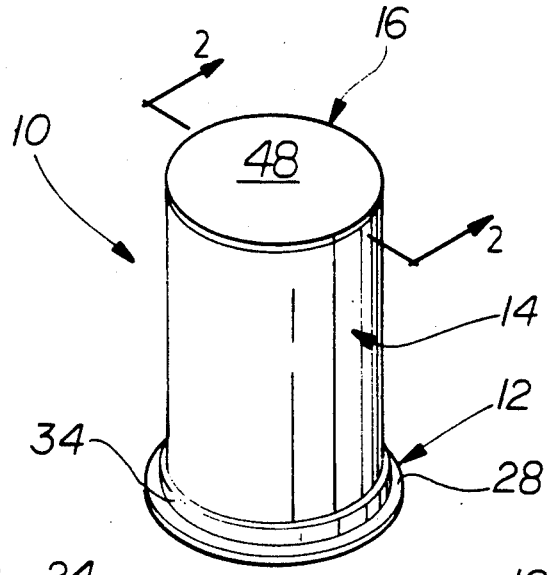
FIG. 1 is a perspective view of a receptacle embodying the invention.
Figure 2:
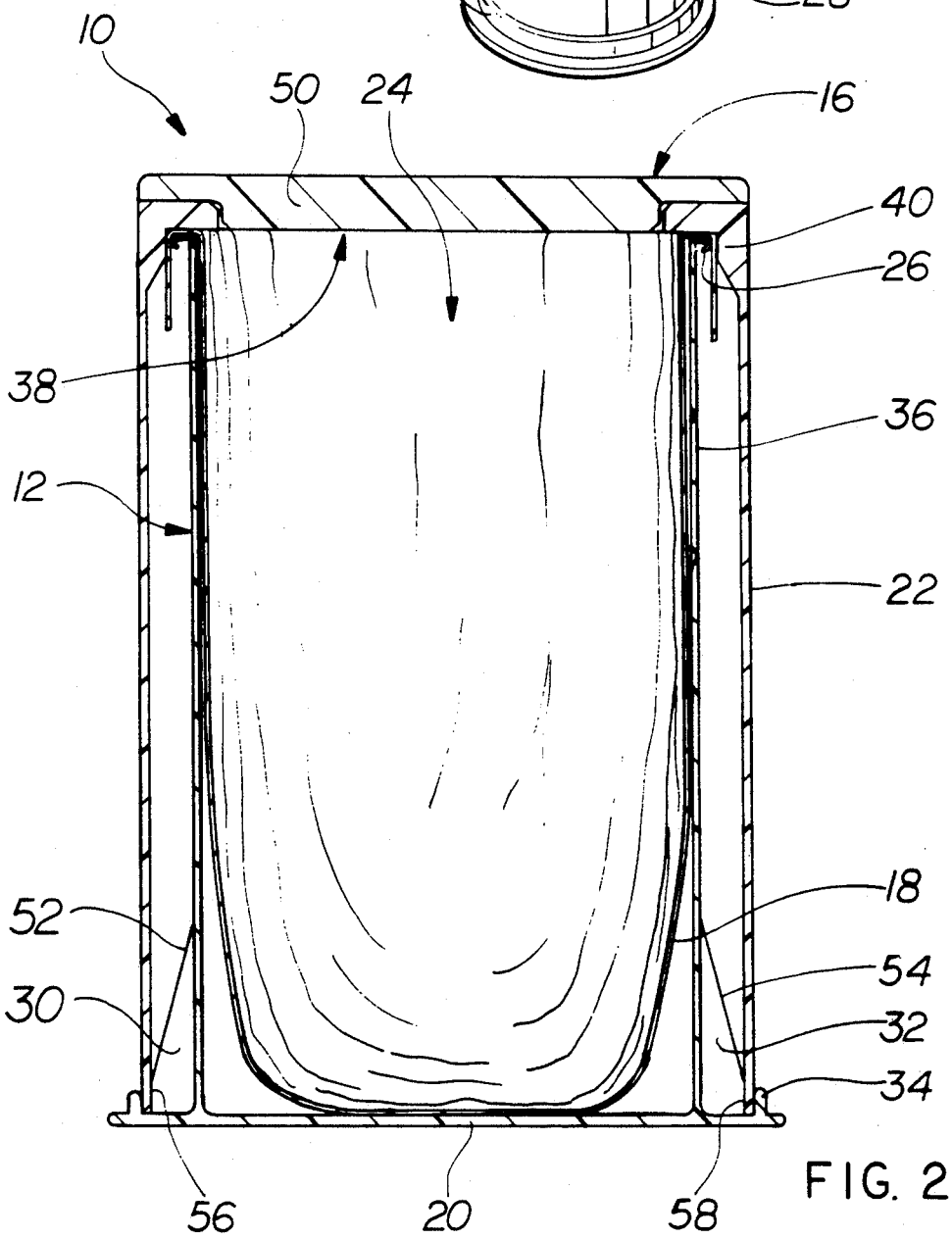
FIG. 2 is a cross-sectional view along the lines 2—2 of FIG. 1.

Reference is made to FIGS. 1 and 2 which detail the construction of a refuse receptacle 10 that incidentally serves as a footstool. It comprises an inner container 12, an outer container 14, and a cap 16. The various components are integrally molded of plastic. As apparent in FIG. 2, the inner container 12 can receive and retain a plastic refuse bag 18 that is supported in an open state between the two containers 12, 14.

The inner container 12 has a closed bottom 20, a generally cylindrical sidewall 22, and a top with a central opening 24. An annular shoulder 26 extends radially outwardly from, and is integrally molded with, an upper portion of the sidewall 22. The shoulder 26 is sufficiently resilient that it deflects elastically from a first orientation illustrated in FIG. 3 downwardly to a second orientation apparent from FIG. 4. The elastic nature of the deflection results in a tendency for the shoulder 26 to spring back to its first orientation, which tendency is exploited to grip the bag 18. A circumferential flange 28 extends radially outwardly from the sidewall 22, substantially coplanar with the bottom surface of the container 12. The flange 28 seats flush against a generally horizontal supporting surface (not illustrated), such as a floor. The upper surface of the flange 28 is shaped to seat the outer container 14, as apparent in FIGS. 1 and 2. The inner container 12 also comprises fin-like centering structure, including exemplary fins 30, 32, extending radially outwardly from its sidewall 22 and a retaining ring 34 extending upwardly from its flange 28, these being used in a manner described more fully below to locate and maintain the lower portion of the outer container 14 on the flange 28.

The outer container 14 has an open bottom, a generally cylindrical sidewall 36, and a top with a central opening 38. The outer container 14 is shaped and dimensioned to releasably receive the lower container 12 through its open bottom. The openings 24, 38 of the containers 12, 14 are then registered and permit refuse to be deposited into the bag 18.

An upper generally annular internal portion 40 of the outer container 14 is shaped to deflect the shoulder 26 of the inner container 12 from its first position to its second position as the outer container 14 receives the inner container 12. This causes the upper portion of the bag 18 to be gripped between the internal portion 40 and the shoulder 26 and maintains the bag in an open state (as in FIGS. 2 and 4). The receptacle 10 can receive a custom bag appropriately dimensioned to seat against the bottom 20 of the inner container 12. However, any bag of sufficient diameter, whether plain or having handles, can be properly gripped and maintained in an open state.

Figure 3:
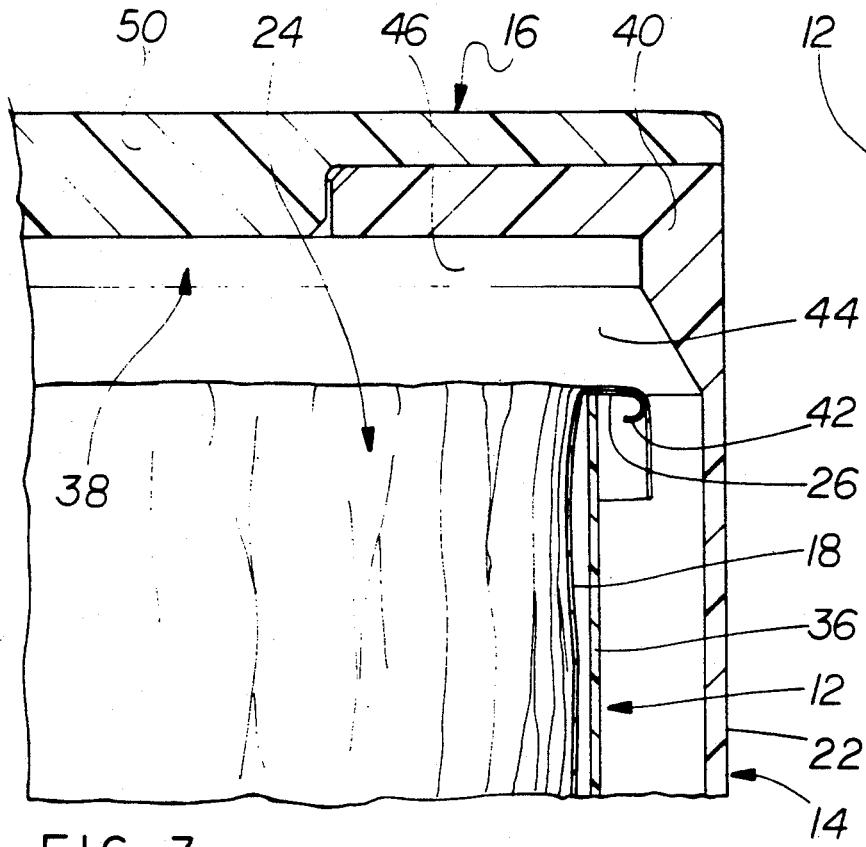
FIG. 3 is an enlarged cross-section showing an outer container that receives an inner container, and detailing the relative orientation of structures intended to grip and maintain a bag in an open state; and, FIG. 4 is a cross-section similar to that of FIG. 3, but showing the relevant structures in an operative bag gripping relationship.
Figure 4:
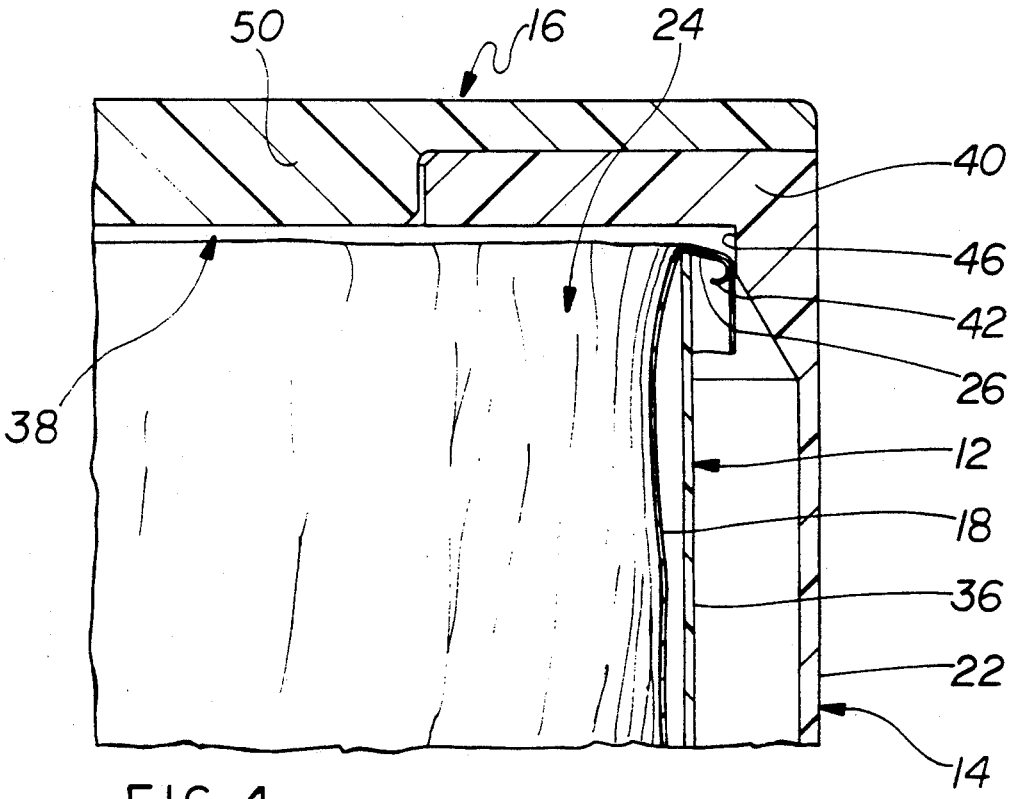

The particular structure used to retain the bag 18 should be noted and is most clearly illustrated in FIGS. 3 and 4. The shoulder 26 has a rounded peripheral portion 42 (numbered in FIGS. 3 and 4 only) that is contacted by the internal portion 40 of the outer container 14. This reduces the likelihood of tearing the bag 18. The internal portion 40 of the outer container 14 is formed with an inclined annular camming surface 44 (numbered in FIGS. 3 and 4 only). The camming surface 44 engages and gradually deflects the shoulder 26 as the camming surface 44 displaces downwardly relative to the shoulder 26 (as in the transition from the orientations in FIGS. 3 and 4). A vertical cylindrical surface 46 (numbered in FIGS. 3 and 4 only) extends upwardly from the camming surface 44. It is dimensioned to closely receive the shoulder 26 from the camming surface 44 in the shoulder's second deflected orientation. This maintains the shoulder 26 in the second orientation and maintains the grip on the bag 18.

In use, the bag 18 is located in the inner container 12 with an upper portion of the bag 18 extending over the shoulder 26 (substantially as in FIG. 3). The outer container 14 is then lowered about the inner container 12. The camming surface 44 deflects the shoulder 26. The user senses a significant resistance to downward movement of the outer container 14 as the shoulder 26 is progressively deflected downwardly inwardly. The shoulder 26 finally arrives, in its deflected orientation, at the inner cylindrical surface 40 (as in FIG. 4). No additional deflecting force is required. The outer container 14 then slides more smoothly relative to the inner container 12, and the user senses that the shoulder 26 has seated within the cylindrical surface 46. The outer container 14 descends until its bottom seats on the flange 28, as in the final orientation of FIG. 2.

The dimensions of the containers 12, 14, particularly sidewall heights, are appropriately selected so that deflection of the shoulder 26 to its second orientation occurs substantially contemporaneously with the seating of the outer container 14 on the flange 28. They are also dimensioned to ensure that the top of the outer container 14 seats substantially contemporaneous on the top of the inner container 12 thereby allowing the two containers 12, 14 to act in concert to resist axial loads. That permits the outer container 14 to be made lighter or with less expensive plastics. An important advantage of seating the upper container 14 on the flange 28 is that the bag 18 is not torn if a person steps abruptly onto the cap 16 or if the receptacle is placed on a carpeted surface where the outer container 14 might otherwise descend quickly under a person's weight. Forces are simply reacted through the flange 28 into the supporting floor surface.

Figure 5:
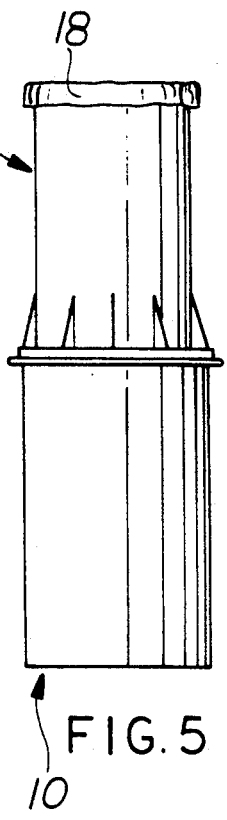
FIG. 5 is a perspective view showing the inner container seated atop the outer container with a refuse bag conveniently elevated for removal.

The receptacle 10 has also been designed to address the problem of conveniently handling and disposing of a refuse bag when full. The user will often want to tie the top of the bag into a knot or tie the top with an appropriate fastener. In the prior art, when a relatively squat trash receptacle has been provided, a user has been obliged to bend to handle the bag. In the receptacle 10, the shape of the bottom of the outer container 14 permits the outer container 14 to rest stably on a horizontal floor surface. The bottom of the inner container 12 is flat and can consequently seats stably on the flat top of the outer container 14, which has comparable surface area. The user may lift the outer container 14 from the lower container, place the outer container 14 on the floor, and then place the inner container 12 atop the outer container 14, as shown in FIG. 5. This elevates the bag 18 to a convenient height for tieing the upper portion of the bag 18. The height of each container 12 or 14 might typically be between 14–16 inches, placing the top of the bag 18 roughly at waist level and within easy reach.

The cap 16 defines a generally horizontal upper surface 48 when seated on the outer container 14. The cap 16 and outer container 14 are constructed in a conventional manner, with appropriate wall thickness and materials, to withstand a vertical axial load of at least 300 pounds applied to the upper surface 48 of the cap 16. Alternatively, one can rely on cooperation between the inner and outer containers 12, 14 to exceed such a load requirement, reducing structural demands on the outer container 14. The cap 16 comprises a cylindrical structure 50 shaped to seat within the opening 38 of the outer container 14 and maintain the cap 16 substantially centered. This reduces lateral displacement of the cap 16 relative to the outer container 14 as a person steps onto the cap 16.

The centering structure is constructed as a multiplicity of radial fins. As apparent in FIG. 2, the exemplary fins 30, 32 define inclined upper surfaces 52, 54 shaped to guide the bottom of the outer container 14 over lower surfaces 56, 58. The lower surfaces 56, 58 are vertically oriented and dimensioned to contact opposing internal surface of the sidewall 36 of the outer container 14 and maintain the bottom of the outer container 14 substantially centered relative to the inner container 12. The other fins are similarly configured. The retaining ring 34 is spaced sufficiently radially outwardly, relative to the centering structure as to receive the sidewall 36 of the container 14 between itself and the centering structure. This arrangement prevent splaying of the bottom of the outer container 14 when a user steps onto the cap 16.

It will be appreciated that a particular embodiment of the invention has been described and that modifications may be made therein without departing from the spirit of the invention or necessarily departing from the scope of the appended claims. In particular, it is within the ambit of the present invention to add a foot-operated mechanism to raise the cap for receipt of refuse.

I claim:

1. A refuse receptacle adapted to hold a refuse bag in an open state, comprising:

an inner container comprising an interior, a closed bottom, a generally cylindrical sidewall, a generally annular structure attached to an upper portion of the sidewall, and a top with a central opening accessing the interior, the inner container being configured to receive the bag through the central opening into its interior with an upper portion of the bag located over the annular structure, the annular structure being sufficiently resilient that the annular structure deflects elastically from a first orientation downwardly and radially to a second orientation; and, an outer container surrounding the inner container, the outer container comprising an open bottom, a generally cylindrical sidewall, a top with a central opening, and a generally annular structure internal to the outer container and attached to at least one of the top and the sidewall of the outer container, the outer container being shaped and dimensioned to releasably receive the inner container through the open bottom of the outer container such that the central openings register and permit refuse to be deposited into the bag through the registered openings;

the annular structure of the outer container being shaped and positioned to deflect the annular structure of the inner container from its first position to its second position as the outer container receives the inner container thereby to grip between them the upper bag portion located over the annular structure of the inner container and to maintain the bag in the open state;

the inner container comprising a circumferential structure extending radially outwardly from a bottom portion of the inner container, the circumferential structure having a lower surface shaped to seat on a horizontal support surface and an upper surface shaped to seat the bottom of the outer container, the inner and outer containers are dimensioned such that the annular structures grip the upper bag portion when the bottom of the outer container seats on the upper surface of the circumferential structure.

2. The refuse receptacle of claim 1 in which the annular structure of the outer container comprises:

a generally annular inclined camming surface that engages and deflects the annular structure of the inner container to the second position as the camming surface displaces downwardly relative to the annular structure of the inner container; and, a generally vertical cylindrical surface extending upwardly from the camming surface and dimensioned to closely receive the annular structure of the inner container in its second orientation from the camming surface thereby to maintain the annular structure in the second orientation.

3. The refuse receptacle of claim 2 in which the annular structure of the inner container extends generally in a radially outward direction relative to the inner container.

4. The refuse receptacle of claim 1 adapted to function as a footstool in which:

the refuse receptacle comprises a cap shaped to seat over the opening of the outer container and to define a generally horizontal upper surface when so seated; and, the cap and the outer container are constructed to withstand a vertical axial load of at least 300 pounds applied to the upper surface of the cap.

5. The refuse receptacle of claim 4 in which the cap comprises structure shaped to seat within the opening of the outer container and maintain the cap substantially centered on the top of the outer container thereby to reduce lateral displacement of the cap relative to the outer container as a person steps onto the cap.

6. The refuse receptacle of claim 4 comprising centering structure attached to the sidewall of the inner container, the centering structure comprising inclined upper surfaces shaped to guide the bottom of the outer container over lower surfaces of the centering structure, the lower surfaces of the centering structure being positioned to maintain the bottom of the outer container substantially centered relative to the inner container.

7. The refuse receptacle of claim 6 comprising retaining structure projecting upwardly from the circumferential structure and spaced radially outwardly relative to the centering structure thereby to receive the sidewall of the outer container between the centering structure and the retaining structure.

8. The refuse receptacle of claim 1 adapted to function as a footstool in which:

the refuse receptacle comprises a cap shaped to seat over the opening of the outer container and to define a generally horizontal upper surface when so seated;

the top of the outer container is shaped to seat on the top of the inner container;

the inner and outer containers are dimensioned such that the top of the outer container seats on the top of the inner container substantially contemporaneously with seating of the bottom of the outer container on the upper surface of the circumferential structure whereby the inner and outer containers cooperate to bear vertical axial loads applied to the upper surface of the cap; and, the cap, the inner container and the outer container are constructed to withstand a vertical axial load of at least 300 pounds applied to the upper surface of the cap.

9. A refuse receptacle adapted to hold a refuse bag in an open state and to function as a footstool, comprising:

an inner container comprising an interior, a closed bottom, a generally cylindrical sidewall, a generally annular structure extending from an upper portion of the sidewall, a top with a central opening, and a circumferential flange extending radially outwardly from a bottom portion of the inner container and shaped to seat on a generally horizontal support surface below the inner container, the inner container being configured to receive the bag through its opening and contain the bag within its sidewall with an upper portion of the bag located over the annular structure, the annular structure being sufficiently resilient that the annular structure deflects elastically from a first orientation downwardly to a second orientation; and, an outer container comprising an open bottom, a generally cylindrical sidewall, a top with a central opening, and a generally annular structure internal to the outer container and attached to at least one of the top and sidewall of the outer container, the outer container being shaped to releasably receive the inner container through the open bottom of the outer container such that the openings of the containers are registered and permit refuse to be deposited into the bag through the registered openings;

the annular structure of the outer container comprising a generally annular inclined camming surface that engages and deflects the annular structure of the inner container to its second orientation as the camming surface displaces downwardly relative to the annular structure of the inner container and a generally vertical cylindrical surface extending upwardly from the camming surface and dimensioned to closely receive the annular structure of the inner container in its second orientation from the camming surface thereby to grip the upper portion of the bag the annular structure of the inner container and to maintain the bag in the open state, the outer container being shaped and dimensioned such that the bottom of the outer container seats on the flange when the annular structure of the inner container is received by the generally vertical cylindrical surface; and, a cap shaped to seat over the opening of the outer container and to define a generally horizontal upper surface when seated, the receptacle being constructed to withstand an axial load of at least 300 pounds applied to the upper surface of the cap.

* * * * *